US006952986B2

(12) United States Patent
Fu

(10) Patent No.: US 6,952,986 B2
(45) Date of Patent: Oct. 11, 2005

(54) FLEXIBLE SOCKET EXTENSION

(75) Inventor: Chun Fa Fu, Taichung (TW)

(73) Assignee: Kun Cen Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/335,757

(22) Filed: Dec. 27, 2002

(65) Prior Publication Data

US 2004/0126195 A1 Jul. 1, 2004

(51) Int. Cl.[7] ..... B25B 23/16

(52) U.S. Cl. ..... 81/177.6; 81/177.2; 81/177.75; 403/157

(58) Field of Search ..... 81/177.2, 177.4, 81/177.6, 177.7, 177.75; 403/54, 58, 113, 116, 157

(56) References Cited

U.S. PATENT DOCUMENTS 541,997 A * 7/1895 Fravega et al. ..... 81/177.75
1,100,097 A * 6/1914 Reed ..... 81/177.6
1,903,660 A * 4/1933 Smith et al. ..... 81/177.6
3,002,409 A * 10/1961 Jones ..... 81/177.2
3,399,584 A 9/1968 Lewicki
4,730,960 A 3/1988 Lewis et al.
4,876,929 A * 10/1989 Kozak ..... 81/177.6
5,638,726 A * 6/1997 Pelkonen et al. ..... 81/177.2
6,044,733 A * 4/2000 Liu ..... 81/177.6
6,142,043 A * 11/2000 Schweiger ..... 81/177.75

* cited by examiner

*Primary Examiner*—James G. Smith
(74) *Attorney, Agent, or Firm*—Charles E. Baxley

(57) ABSTRACT

A flexible socket extension includes two connectors disposed in two ends of a flexible housing, and a number of torque transmitting elements received in the flexible housing and coupled between the connectors. One of the torque transmitting elements includes a neck and a tongue which has a width greater than that of the neck. The other torque transmitting element includes a lateral groove for receiving the tongue, and having two juts extended into the lateral groove, for engaging with the tongue and for rotatably retaining the torque transmitting elements together.

18 Claims, 6 Drawing Sheets

FLEXIBLE SOCKET EXTENSION

BACKGROUND OF THE INVENTION

1. Field of the Invention

The present invention relates to a flexible socket extension, and more particularly to a flexible socket extension having a solid coupling configuration.

2. Description of the Prior Art

Various kinds of typical flexible socket extensions have been developed for allowing fasteners in deep environment to be easily rotated or driven by tools with the flexible socket extensions.

The earliest flexible socket extensions comprise a coil spring coupled between two couplers, one of the couplers is coupled to the tool, and the other is coupled to the fastener. However, the driving torque of the flexible socket extension is small, and may not be used to effectively drive or rotate the fasteners.

U.S. Pat. No. 3,399,584 to Lewicki discloses another typical flexible socket extension including a number of ball bearings received in a coil spring, and a number of joint bearings are required to be disposed between the ball bearings. However, the ball bearings also may not be solidly coupled together and may have a good chance to be separated from each other.

U.S. Pat. No. 4,730,960 to Lewis et al. discloses a further typical flexible socket extension including a number of torque transmitting elements received in a coil spring or a flexible housing. The torque transmitting elements include radial grooves and tongue elements engaged with each other for torque transmitting purposes. However, the tongue elements of the torque transmitting elements may also have a good chance to be disengaged from the radial grooves of the other torque transmitting elements.

The present invention has arisen to mitigate and/or obviate the afore-described disadvantages of the conventional flexible socket extensions.

SUMMARY OF THE INVENTION

The primary objective of the present invention is to provide a flexible socket extension including a solid coupling configuration for allowing the torque transmitting elements to be solidly coupled together and to be prevented from being separated or disengaged from each other.

In accordance with one aspect of the invention, there is provided a flexible socket extension comprising a flexible housing including two ends, a first and a second connectors disposed in the ends of the flexible housing, and a first and a second torque transmitting elements received in the flexible housing and coupled between the first and the second connectors. The first torque transmitting element includes a first end having a neck and a tongue extended therefrom, the neck including a width smaller than that of the tongue for defining two depressions on sides of the neck and between the tongue and the first torque transmitting element. The second torque transmitting element includes a first end having a lateral groove formed therein to receive the tongue of the first torque transmitting element, and having two juts extended into the lateral groove thereof and engaged into the depressions and engaged with the tongue of the first torque transmitting element, for retaining the first and the second torque transmitting elements together, and for preventing the first and the second torque transmitting elements from being disengaged from each other.

The lateral groove of the second torque transmitting element and the tongue of the first torque transmitting element include a circular cross section and rotatably engaged with each other for rotatably coupling the torque transmitting elements together.

A first and a second barrels may further be provided and engaged onto the ends of the flexible housing respectively, the first and the second connectors may be received in the first and the second barrels respectively.

The first connector is rotatably secured to the first barrel with such as a spring biased projection or with a retaining ring. A spring biasing device may further be provided for biasing the first and the second barrels relative to the flexible housing.

The first connector includes a neck and a tongue extended therefrom and engageable into the lateral groove of the second torque transmitting element, and includes two depressions formed on sides of the neck and between the tongue and the first connector. The tongue of the first connector preferably includes a circular cross section.

The second connector includes a lateral groove formed therein to receive the tongue of the first torque transmitting element, and having two juts extended into the lateral groove thereof and engaged into the depressions and engaged with the tongue of the first torque transmitting element, for retaining the first torque transmitting element and the second connector together, and for preventing the first torque transmitting element and the second connector from being disengaged from each other.

The lateral groove of the second connector and the tongue of the first torque transmitting element include a circular cross section and rotatably engaged with each other for rotatably coupling the first torque transmitting element and the second connector together.

The first torque transmitting element includes a second end having a lateral groove formed therein to selectively receive the tongue of the first torque transmitting element.

The second end of the second torque transmitting element may alternatively include a neck and a tongue extended therefrom, and engageable into the lateral groove of the second torque transmitting element.

The first torque transmitting element includes a second end having a second neck and a second tongue, the second neck includes a width smaller than that of the second tongue for defining two depressions on sides of the second neck and between the second tongue and the first torque transmitting element.

The second connector includes a lateral groove formed therein to receive the second tongue of the first torque transmitting element, and having two juts extended into the lateral groove thereof and engaged into the depressions and engaged with the second tongue of the first torque transmitting element.

A third torque transmitting element may further be provided and includes a lateral groove formed therein to receive the second tongue of the first torque transmitting element, and having two juts extended into the lateral groove thereof and engaged into the depressions and engaged with the second tongue of the first torque transmitting element.

The second end of the second torque transmitting element may alternatively include a second lateral groove formed therein for selectively receiving the tongue of the first torque transmitting element, and having two juts extended into the second lateral groove thereof and engaged into the depressions and engaged with the tongue of the first torque transmitting element.

Another torque transmitting element may further be provided and may include a neck and a tongue extended therefrom and engageable into the second lateral groove of the second torque transmitting element, and includes two depressions formed on sides of the neck and between the tongue and the third torque transmitting element.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
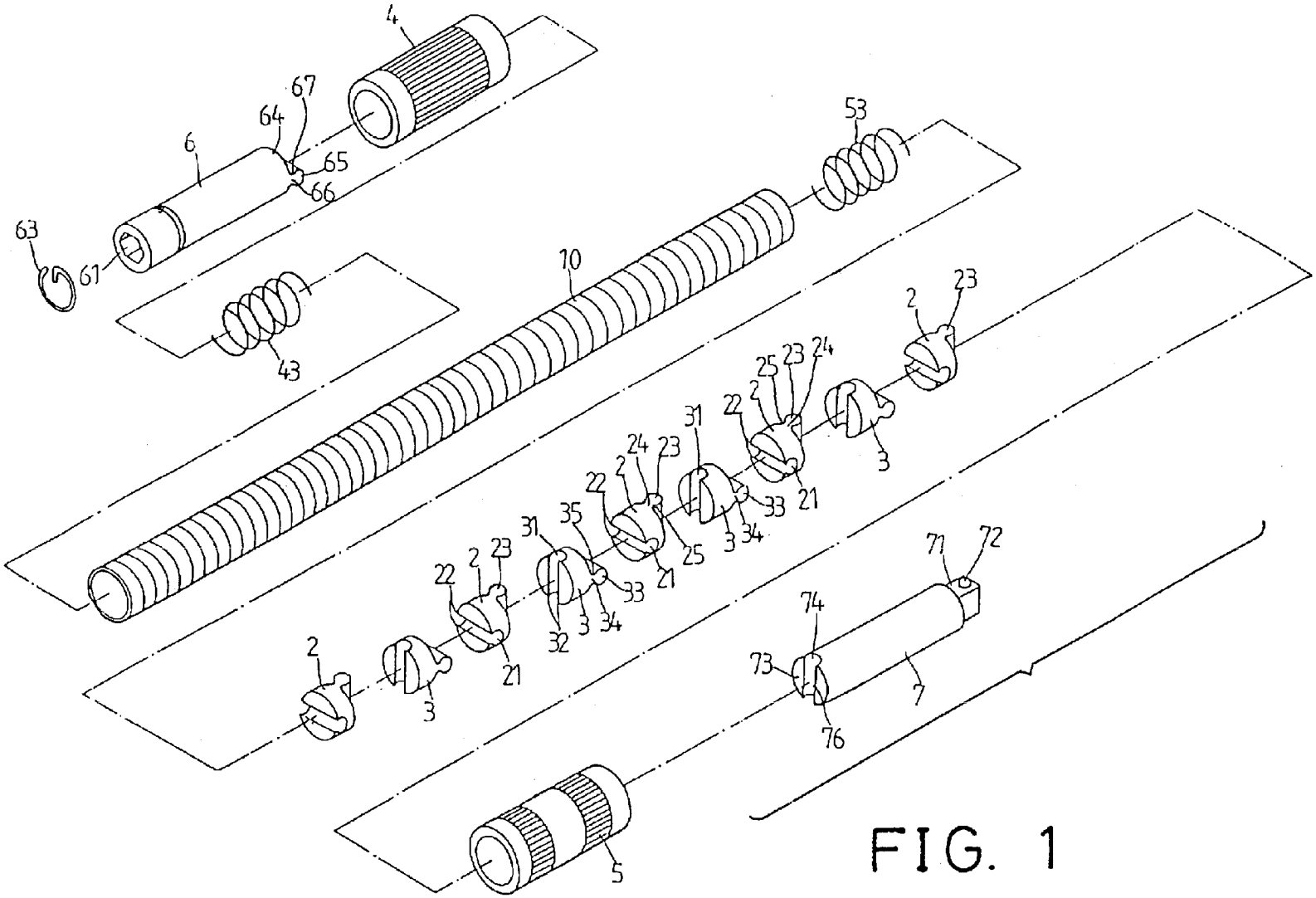
FIG. 1 is an exploded view of a flexible socket extension in accordance with the present invention.
Figure 2:
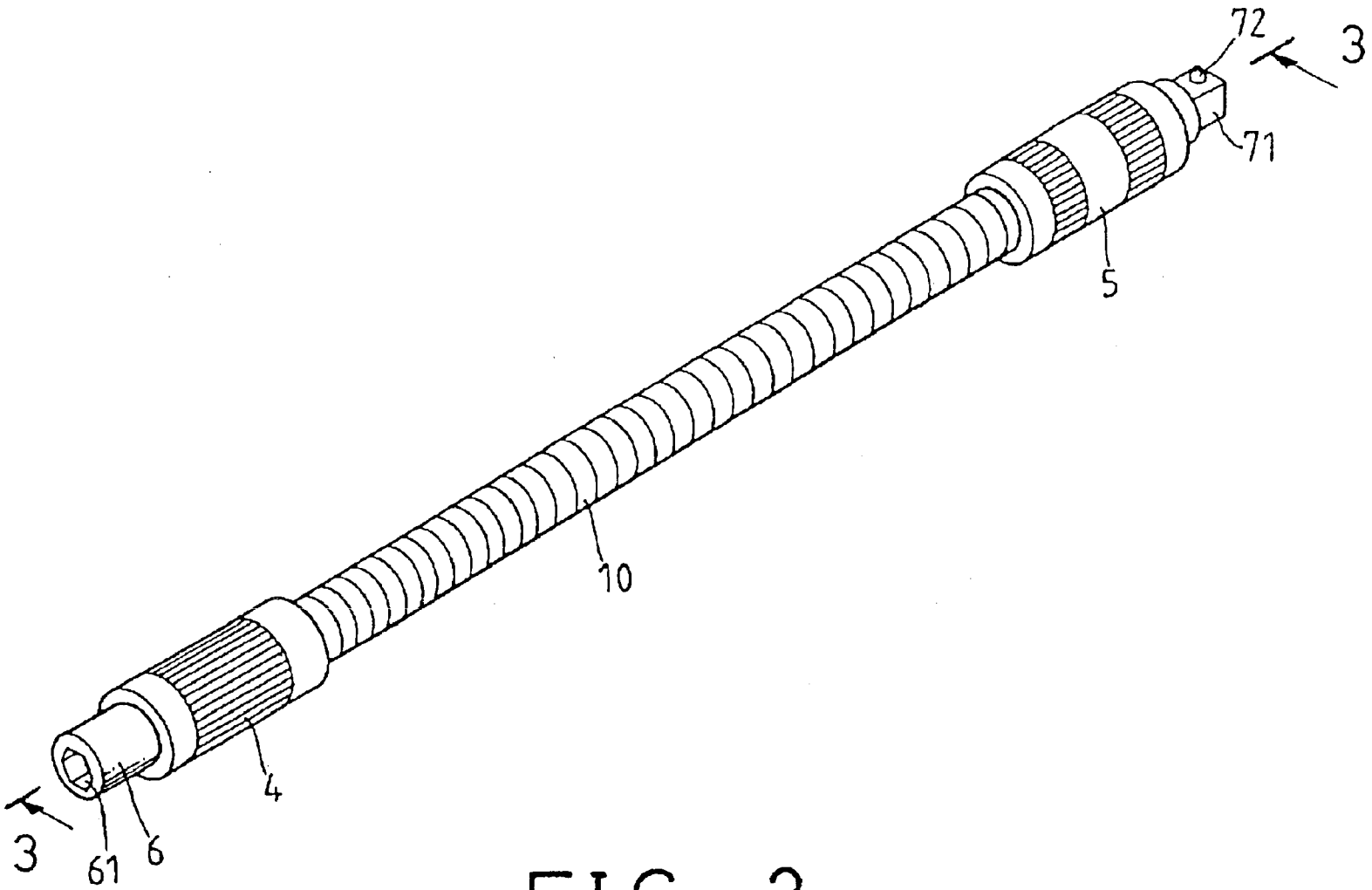
FIG. 2 is a perspective view of the flexible socket extension.
Figure 3:
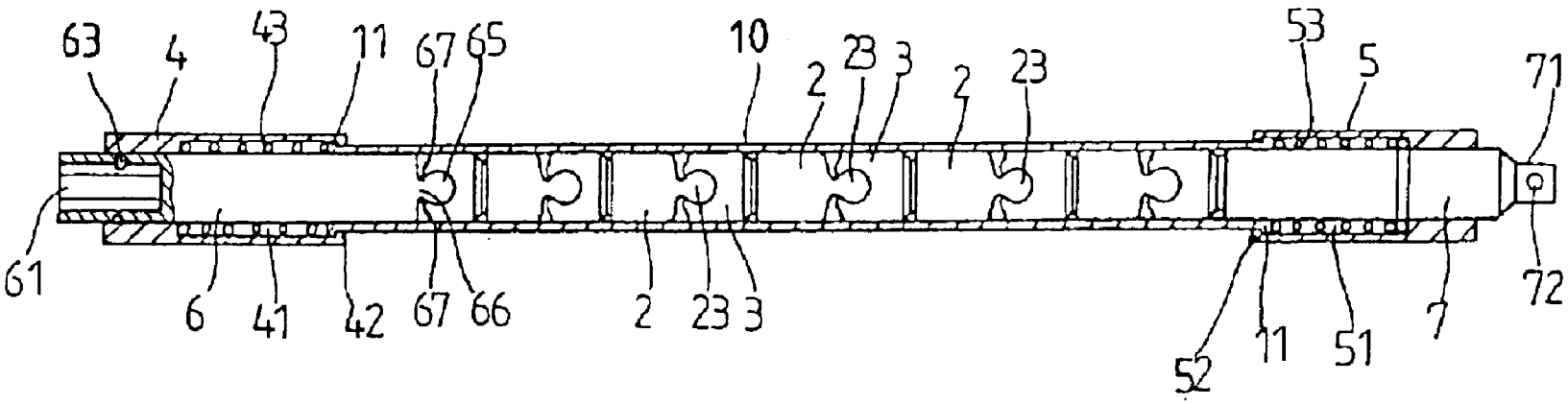
FIG. 3 is a cross sectional view taken along lines 3—3 of FIG. 2.
Figure 4:
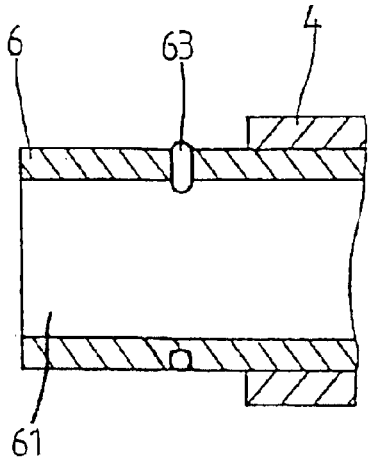
FIG. 4 is an enlarged partial cross sectional view of the flexible socket extension.
Figure 5:
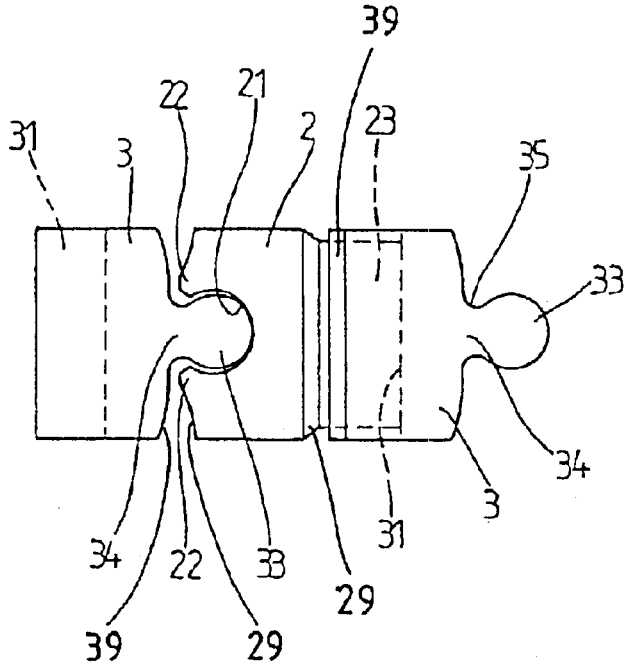
FIG. 5 is an enlarged partial plan schematic view of the flexible socket extension.
Figure 6:
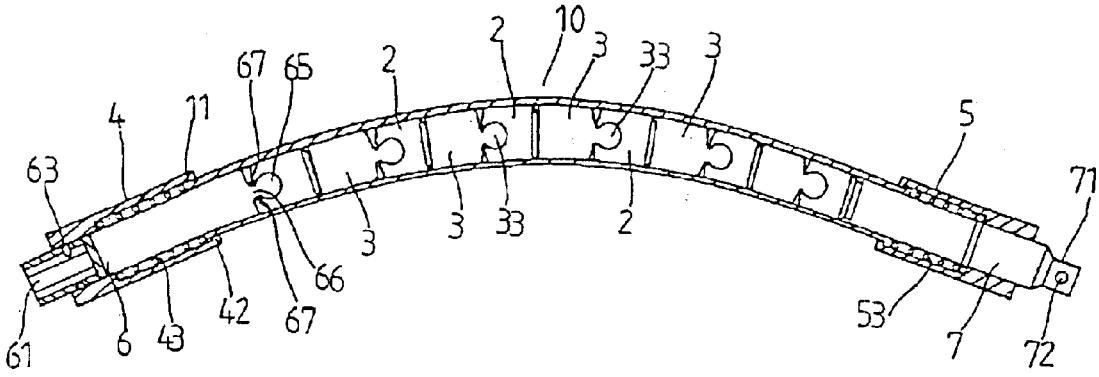
FIG. 6 is a cross sectional view similar to FIG. 3, illustrating the operation of the flexible socket extension.

Referring to the drawings, and initially to FIGS. 1–5, a flexible socket extension in accordance with the present invention comprises a typical flexible housing 10 made or formed by such as a coil spring, and including two ends each having a peripheral flange 11 extended radially and outwardly therefrom (FIGS. 3, 6). A soft or rubber or protective covering 12 (FIG. 7) may further be provided and engaged onto the outer peripheral portion of the flexible housing 10.

Two barrels 4, 5 each includes a bore 41, 51 formed therein for slidably receiving the ends of the flexible housing 10 respectively, and each includes a peripheral flange 42, 52 extended radially and inwardly from one end thereof for engaging with the peripheral flange 11 of the flexible housing 10, and for limiting the relative movement between the flexible housing 10 and the barrels 4, 5. The users may hold the barrels 4, 5 while operating the flexible socket extension.

Two springs 43, 53 are received in the bores 41, 51 of the barrels 4, 5 respectively, and are engaged between the barrels 4, 5 and the ends or the peripheral flanges 11 of the flexible housing 10, for biasing the peripheral flanges 42, 52 of the barrels 4, 5 toward or to engage with the peripheral flanges 11 of the flexible housing 10, and thus for allowing the barrels 4, 5 to be moved relative to the flexible housing 10 against the springs 43, 53 respectively.

A connector 6 is received in the barrel 4, and includes an outer end having an engaging opening 61 formed therein for receiving such as tool driving shanks (not shown), and for allowing the connector 6 to be rotated by the other, tools (not shown). The connector 6 may be detachably secured to the barrel 4 with such as one or more spring-biased projections (not shown), or with a clamping ring 63, for preventing the connector 6 from being moved relative to the barrel 4, but for allowing the connector 6 to be rotated relative to the barrel 4.

Figure 8:
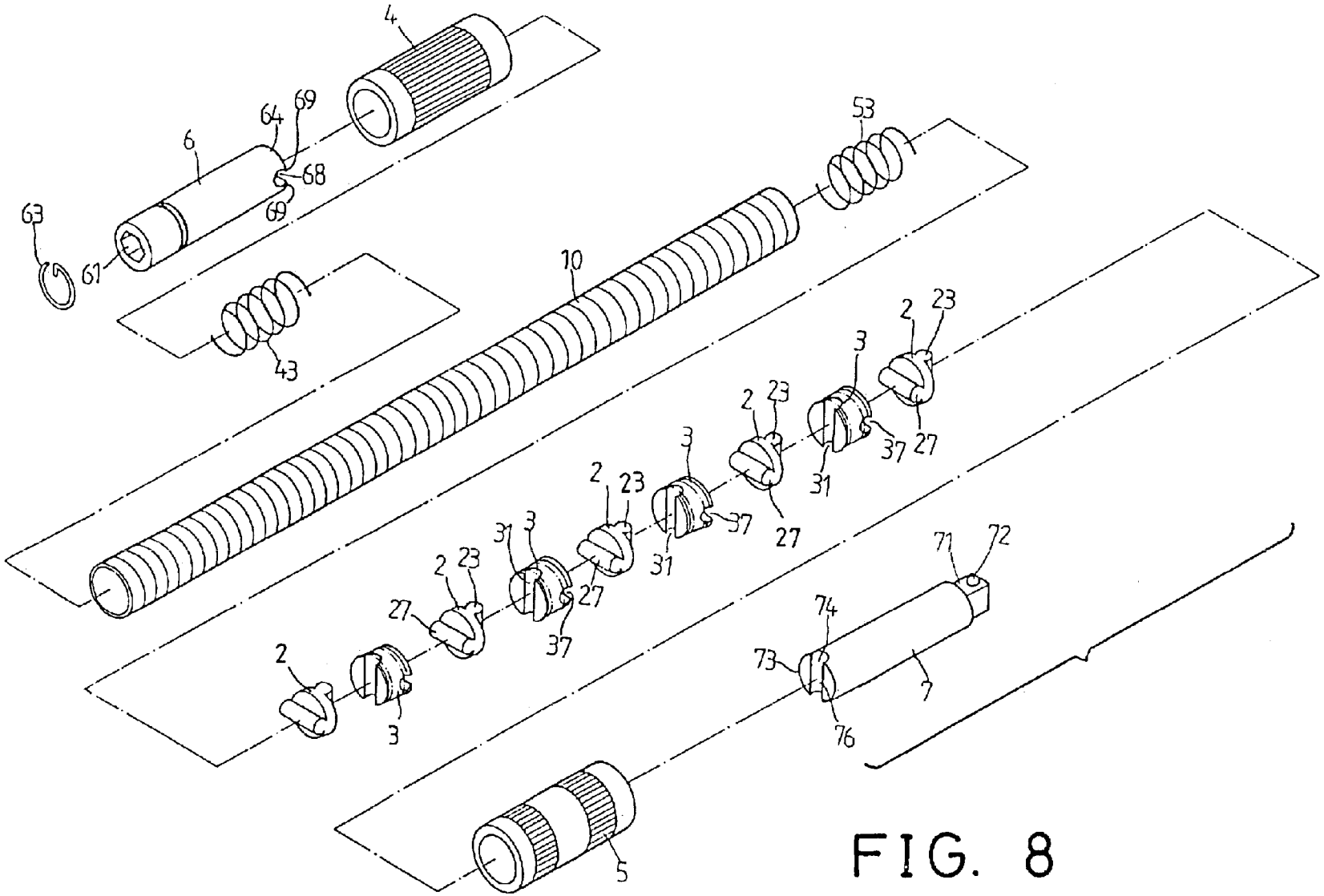
FIG. 8 is an exploded view similar to FIG. 1, illustrating the other embodiment of the flexible socket extension.

The connector 6 includes an inner end 64 having a tongue 65 laterally extended therefrom, and a neck 66 formed between the connector 6 and the tongue 65. The neck 66 includes a width smaller than that of the tongue 65 for forming or defining two depressions 67 on the side of the neck 66 and between the tongue 65 and the inner end 64 of the connector 6. Alternatively, as shown in FIG. 8, the inner end 64 of the connector 6 may include a lateral groove 68 formed therein, and two juts 69 oppositely extended into the groove 68 thereof.

The other connector 7 is received in the other barrel 5, and includes an outer end having a driving shank 71 and a spring biased projection 72 provided thereon for engaging with or for coupling to fasteners or the other tool extensions or tool members. The inner end 73 of the connector 7 may include a lateral groove 74 formed therein, and two juts 76 oppositely extended into the groove 74 thereof. Alternatively, the connector 7 may also include a tongue laterally extended therefrom (not shown), similar to the tongue 65 of the connector 6.

A number of torque transmitting elements 2, 3 are further provided and to be coupled between the connectors 6, 7 for transmitting torques between the connectors 6, 7, and each includes one end having a lateral groove 21, 31 formed therein, and two juts 22, 32 oppositely extended into the groove 21, 31 thereof respectively.

The torque transmitting elements 2, 3 each includes a tongue 23, 33 laterally extended from the other end thereof, and a neck 24, 34 formed between the respective torque transmitting element 2, 3 and the tongue 23, 33. The neck 24, 34 includes a width smaller than that of the tongue 23, 33 for forming or defining two depressions 25, 35 on the two sides of the neck 24, 34 and between the respective tongue 23, 33 and the respective torque transmitting element 2, 3.

As shown in FIGS. 1, 3, 5, 6, the tongues 23, 33 are preferably perpendicular to the respective lateral grooves 21, 31 of the torque transmitting elements 2, 3. The tongues 23, 33, 65 of the torque transmitting elements 2, 3 or of the connector 6 may be received or engaged in the lateral grooves 21, 31, 68, 74 of the other torque transmitting elements 2, 3, or of the connectors 5, 7 (FIG. 8), and retained to the respective torque transmitting elements 2, 3 or the connectors 5, 7 by the juts 22, 32, 69, 76.

The juts 22, 32, 69, 76 of the respective torque transmitting elements 2, 3, and the connectors 6, 7 may engage into the respective depressions 25, 35, 67 and may engage with the tongues 23, 33, 65 of the other torque transmitting elements 2, 3, and of the connectors 6, 7, such that the torque transmitting elements 2, 3 may be solidly coupled together and solidly coupled between the connectors 6, 7, and such that the torque transmitting elements 2, 3, and the connectors 6, 7 will not be moved or disengaged from each other.

Figure 7:
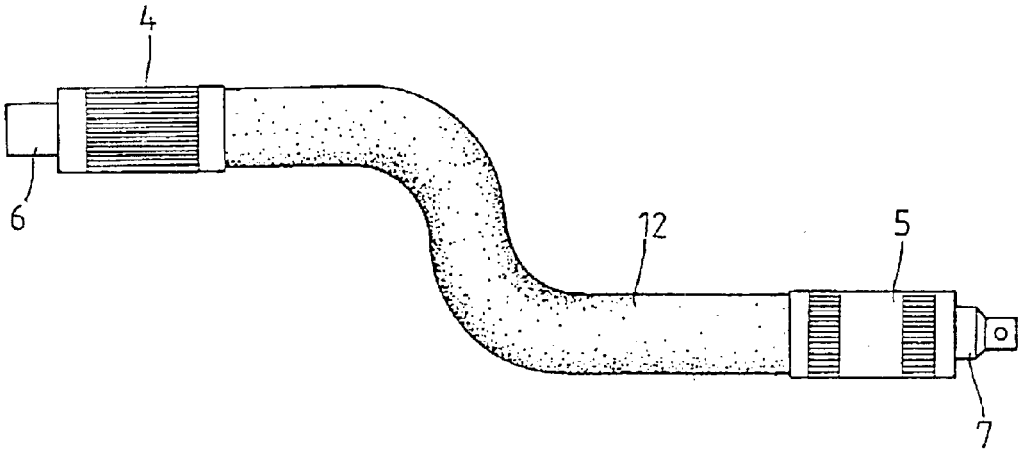
FIG. 7 is a plan schematic view illustrating the operation of the flexible socket extension.

It is preferable that the tongues 23, 33, 65 and the lateral grooves 21, 31, 68, 74 of the torque transmitting elements 2, 3, and of the connectors 6, 7 include a circular cross section, for allowing the torque transmitting elements 2, 3 and the connectors 6, 7 to be rotated relative to each other by the rotational engagement of the tongues 23, 33, 65 in the lateral grooves 21, 31, 68, 74 of the respective torque transmitting elements 2, 3, and the connectors 6, 7 (FIGS. 6, 7).

Alternatively, as shown in FIG. 8, the torque transmitting elements 2 may include another tongue 27 extended therefrom and opposite to the tongue 23 thereof, and the other torque transmitting elements 3 may include another lateral groove 37 formed therein and opposite to the lateral groove 31 thereof, for receiving the tongues 24, 27, 33, 65 of the other torque transmitting elements 2, 3, and of the connector 6, 7.

As shown in FIG. 5, the torque transmitting elements 2, 3 each includes two ends each having an angled or inclined or tapered peripheral surface 29, 39 formed therein, for allowing the torque transmitting elements 2, 3 to be rotated relative to each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flexible socket extension comprising:

a flexible housing including two ends, a first and a second connectors disposed in said ends of said flexible housing, and a first and a second torque transmitting elements received in said flexible housing and coupled between said first and said second connectors, said first torque transmitting element including a first end having a neck and a tongue extended therefrom, said neck including a width smaller than that of said tongue for defining two depressions on sides of said neck and between said tongue and said first torque transmitting element, and said second torque transmitting element including a first end having a lateral groove formed therein to receive said tongue of said first torque transmitting element, and having two juts extended into said lateral groove thereof and engaged into said depressions and engaged with said tongue of said first torque transmitting element, for retaining said first and said second torque transmitting elements together, and for preventing said first and said second torque transmitting elements from being disengaged from each other.

2. The flexible socket extension according to claim 1, wherein said lateral groove of said second torque transmitting element and said tongue of said first torque transmitting element include a circular cross section and rotatably engaged with each other for rotatably coupling said first and said second torque transmitting elements together.

3. The flexible socket extension according to claim 1 further comprising a first and a second barrels engaged onto said ends of said flexible housing respectively, said first and said second connectors being received in said first and said second barrels respectively.

4. The flexible socket extension according to claim 3, wherein said first connector is rotatably secured to said first barrel.

5. The flexible socket extension according to claim 3 further comprising means for biasing said first and said second barrels relative to said flexible housing.

6. The flexible socket extension according to claim 1, wherein said first connector includes a neck and a tongue extended therefrom and engageable into said lateral groove of said second torque transmitting element, and includes two depressions formed on sides of said neck and between said tongue and said first connector.

7. The flexible socket extension according to claim 6, wherein said tongue of said first connector includes a circular cross section.

8. The flexible socket extension according to claim 1, wherein said second connector includes a lateral groove formed therein to receive said tongue of said first torque transmitting element, and having two juts extended into said lateral groove thereof and engaged into said depressions and engaged with said tongue of said first torque transmitting element, for retaining said first torque transmitting element and said second connector together, and for preventing said first torque transmitting element and said second connector from being disengaged from each other.

9. The flexible socket extension according to claim 8, wherein said lateral groove of said second connector and said tongue of said first torque transmitting element include a circular cross section and rotatably engaged with each other for rotatably coupling said first torque transmitting element and said second connector together.

10. The flexible socket extension according to claim 1, wherein said first torque transmitting element includes a second end having a lateral groove formed therein to receive said tongue of said first torque transmitting element.

11. The flexible socket extension according to claim 1, wherein said second torque transmitting element includes a second end having a neck and a tongue extended therefrom, and engageable into said lateral groove of said second torque transmitting element.

12. The flexible socket extension according to claim 1, wherein said first torque transmitting element includes a second end having a second neck and a second tongue extended therefrom, said second neck includes a width smaller than that of said second tongue for defining two depressions on sides of said second neck and between said second tongue and said first torque transmitting element.

13. The flexible socket extension according to claim 12, wherein said second connector includes a lateral groove formed therein to receive said second tongue of said first torque transmitting element, and having two juts extended into said lateral groove thereof and engaged into said depressions and engaged with said second tongue of said first torque transmitting element.

14. The flexible socket extension according to claim 12 further comprising a third torque transmitting element including a lateral groove formed therein to receive said second tongue of said first torque transmitting element, and having two juts extended into said lateral groove thereof and engaged into said depressions and engaged with said second tongue of said first torque transmitting element.

15. The flexible socket extension according to claim 1, wherein said second torque transmitting element includes a second end having a second lateral groove formed therein for selectively receiving said tongue of said first torque transmitting element, and having two juts extended into said second lateral groove thereof and engaged into said depressions and engaged with said tongue of said first torque transmitting element.

16. The flexible socket extension according to claim 15 further comprising a third torque transmitting element including a neck and a tongue extended therefrom and engageable into said second lateral groove of said second torque transmitting element, and includes two depressions formed on sides of said neck and between said tongue and said third torque transmitting element.

17. The flexible socket extension according to claim 1, wherein said first torque transmitting element includes an inclined peripheral surface formed in said first end thereof, and includes a second end having an inclined peripheral surface formed therein.

18. The flexible socket extension according to claim 1, wherein said second torque transmitting element includes an inclined peripheral surface formed in said first end thereof, and includes a second end having an inclined peripheral surface formed therein.

* * * * *